US005259776A

United States Patent [19]

Giroux

[11] Patent Number: 5,259,776

[45] Date of Patent: * Nov. 9, 1993

[54] FULLY PROGRAMMABLE DIN CONNECTOR

[75] Inventor: David C. Giroux, Gorham, Me.

[73] Assignee: Augat Inc., Mansfield, Mass.

[ * ] Notice: The portion of the term of this patent subsequent to Dec. 10, 2008 has been disclaimed.

[21] Appl. No.: 830,363

[22] Filed: Jan. 31, 1992

[51] Int. Cl.[5] ..... H01R 29/00

[52] U.S. Cl. ..... 439/188; 439/513; 439/43

[58] Field of Search ..... 439/510-513, 439/188, 636, 43; 200/51.09, 51.1

[56] References Cited

U.S. PATENT DOCUMENTS 4,220,393 9/1980 Ammon et al. ..... 439/682
4,342,495 8/1982 Bennett et al. ..... 439/689
4,516,817 5/1985 Deters ..... 439/513
4,607,899 8/1986 Romine et al. ..... 439/512
5,052,936 10/1991 Biechler et al. ..... 439/636
5,071,362 12/1991 Martens et al. ..... 439/188

*Primary Examiner*—Gary F. Paumen
*Attorney, Agent, or Firm*—Weingarten, Schurgin, Gagnebin & Hayes

[57] ABSTRACT

The fully programmable DIN connectors constructed in accordance with the present invention have housing bodies comprised of a plurality of like cells that are each capable of receiving shorting clips and that, when shorting clips are selectively received therewithin, enable the same housing body to be programmed to satisfy the requirements of all possible applications. The shorting clips are preferably top loadable into the housing body, plural sockets are preferably bottom loadable therewithin and a top cover is attached to the fully programmable housing body.

22 Claims, 5 Drawing Sheets

FULLY PROGRAMMABLE DIN CONNECTOR

FIELD OF THE INVENTION

This invention is directed to the field of electrical interconnection devices, and more particularly, to a fully programmable DIN connector.

BACKGROUND OF THE INVENTION

So-called DIN connectors include a housing body supporting plural contacts typically either in a three (3) by thirty-two (32) array or in a three (3) by forty (40) array. Each contact of the array of contacts of such DIN connectors typically has a pin rearwardly extending beyond the housing body and a socket embedded therewithin and frontwardly accessible through a corresponding opening provided therefor through the connector top face.

In many applications, such as in some computer network interfaces, there is a need to electrically connect (short) two or more contacts of such connectors pairwise whenever both of their corresponding sockets are free from pins but to electrically disconnect the same whenever either of their corresponding sockets has a pin of a mating connector inserted thereinto. Heretofore, to solve this problem, each connector was specially configured to receive one or more shorting clips at those specific locations of the three (3) by thirty-two (32) or three (3) by forty (40) array that corresponded to the one or more pairs of contacts to be selectively shorted. The shorting clips, embedded within the housing body at those specific locations, electrically-shorted the selected contacts together. But for each configuration of different contacts selected to be shorted, another specially configured housing body having one or more shorting clip receiving cavities conforming to each pattern of contact pairs needed to be manufactured and stockpiled, with consequent materials and labor wastage, and undesirable stockpiling of inventory.

SUMMARY OF THE INVENTION

It is accordingly the principal object of the present invention to provide a fully programmable DIN or other similar connector that enables the same connector to be programmed to electrically short any selected one or more pairs of contacts thereby eliminating the prior art need to manufacture a different connector for each different pattern of one or more pairs of contacts to be shorted and eliminating the need to maintain an inventory of different connectors for each different pattern of contact pairs selected. In accord with this object, the disclosed fully programmable connector of the present invention includes a housing body having opposing top and bottom faces between which a plurality of identical, selectively programmable cells are arrayed in a selected DIN configuration. Each of the cells is comprised by first walls that open to the top face of the housing body and define a top-face-loadable shorting clip supporting member, by second walls that open to the top face and define socket receiving cavities to both longitudinal sides of the shorting clip supporting members and by third walls that open to the bottom face and define to both longitudinal sides of the shorting clip supporting members bottom loadable contact receiving and supporting cavities. In addition, a plurality of contacts having integral sockets and pins are bottom loaded into the bottom loadable contact receiving and supporting cavities defined by the third walls of the cells, with their sockets received in a corresponding socket receiving cavity and with their pins individually extending beyond the bottom face of the housing body. Further, one or more shorting clips are top loaded into the housing body and supported by the associated shorting clip supporting members of any one or more selected cells. In further accord therewith, a housing cover is mated to the top face of the housing body, preferably by ultrasonic welding.

BRIEF DESCRIPTION OF THE DRAWINGS

Other objects, aspects and features of the instant invention will become apparent as the invention becomes better understood by referring to the following detailed description of the preferred embodiment thereof, and to the drawings, wherein.

DETAILED DESCRIPTION OF THE PREFERRED EMBODIMENTS

Figure 1:
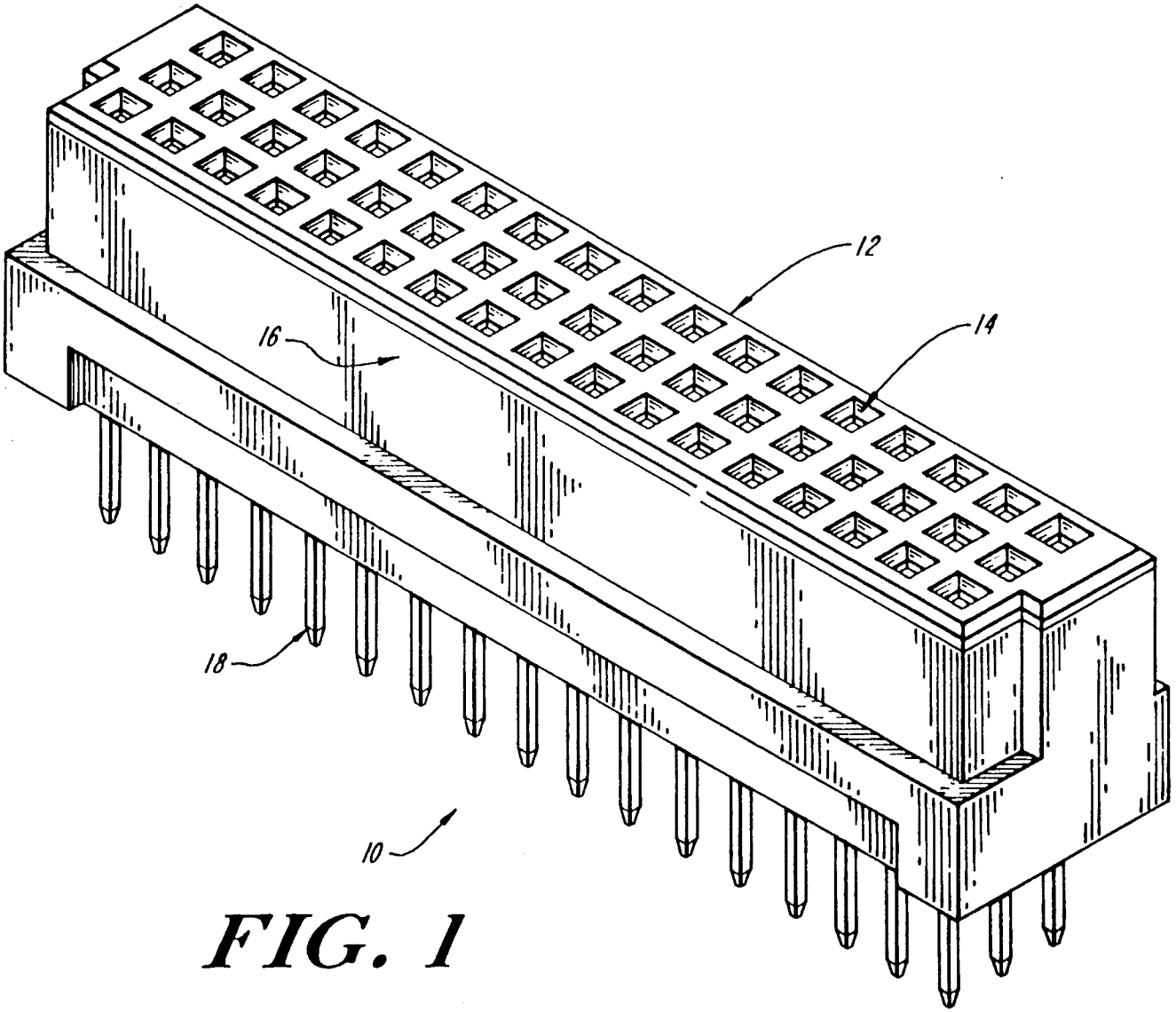
FIG. 1 is a perspective view of a DIN connector constructed in accord with the present invention.

Referring now to FIG. 1, the DIN connector of the invention is generally designated at 10. The connector 10 includes a separable cover member generally designated 12 having an array of openings generally designated 14 thereinthrough, a fully programmable housing body generally designated 16 and a plurality of bottom loadable contacts generally designated 18. The openings 14 of the cover 12 and the contacts 18 bottom loadable into the housing body 16 define an exemplary three (3) by seventeen (17) DIN connector array, although, as will be appreciated by those skilled in the art, other DIN array configurations than that specifically illustrated are contemplated.

Figure 2:
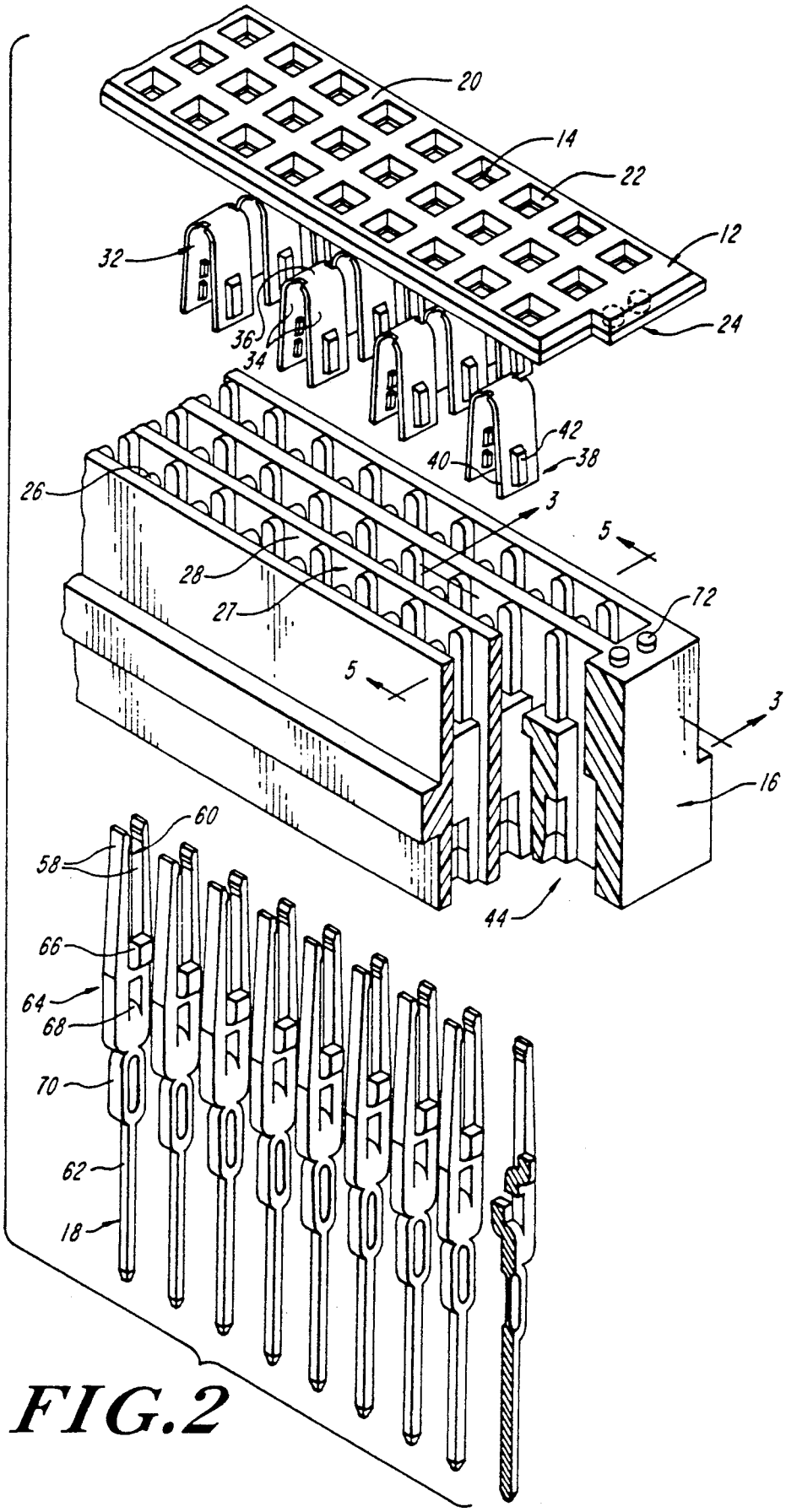
FIG. 2 is an exploded perspective view of a portion of a DIN connector constructed in accord with the present invention.

Referring now to FIG. 2, the cover 12 is constituted as a generally planar top member 20 through which the openings 14 are integrally formed in such a way that outwardly facing beveled walls 22 surround each of the openings 14 to facilitate the entry thereinto of the pins of a mating connector, not shown. One or more walls defining one or more post receiving apertures illustrated generally at 24 are provided at the longitudinal ends of the cover 12. The one or more apertures 24 cooperate with posts to be described to secure the cover 12 to the fully programmable housing body 16.

In accord with the present invention, the fully programmable housing body 16 is constructed of a plurality of identical cells that perform two functions. The first is to receive from the top face thereof one or more shorting clips and to support the same within the housing body 16 in position to electrically short-circuit any selected one or more pairs of longitudinally adjacent contacts 18. The second is to receive through the bottom face thereof the contacts 18 and to retain the same therewithin in such manner both that each is aligned with another opening 14 of the cover 12 and that adjacent pairs thereof are in position to be electrically shorted when such pairs have been selected to be electrically shorted by corresponding one or more shorting clips.

Figure 3:
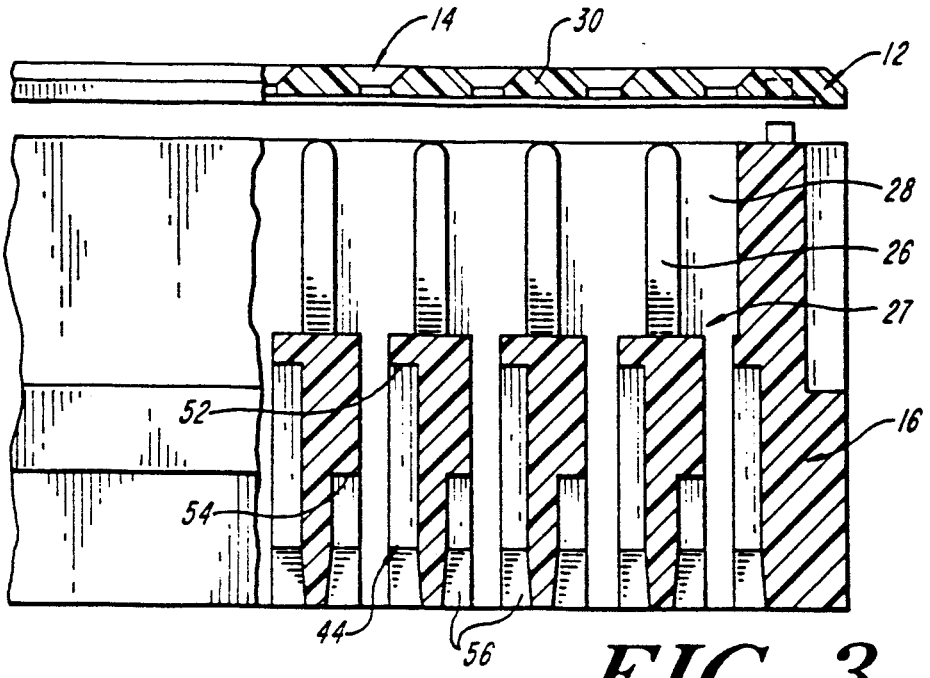
FIG. 3 is a longitudinal section along the lines 3—3 of FIG. 2 shown with the cover exploded from the body and with the cells empty of shorting clips and contacts.
Figure 4:
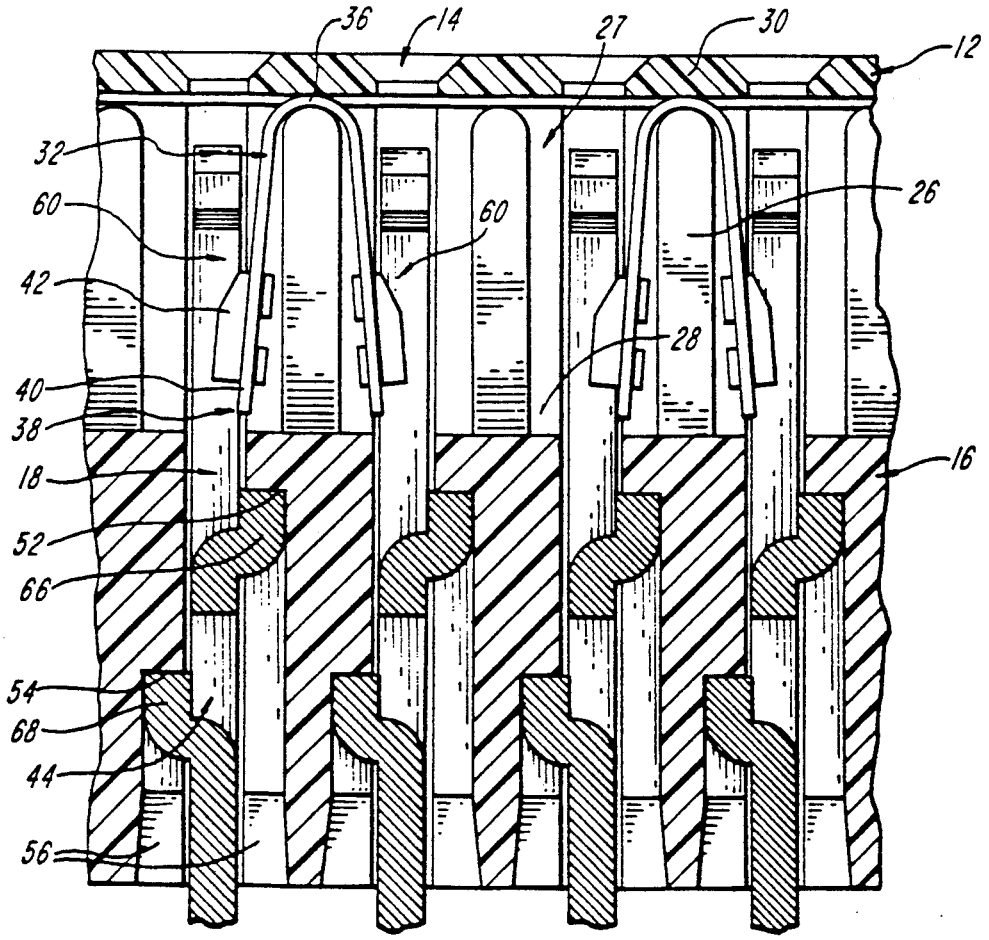
FIG. 4 likewise is a partial longitudinal section but shown with the cover in bonded relation to the housing body and with shorting clips selectively loaded into and with contacts loaded into the fully programmable cells of the housing body.

In the presently preferred embodiment, confronting pairs of vertically extending, rounded-top shorting clip supporting ribs 26 are formed in longitudinally-spaced relation along transversely-spaced, longitudinally-extending and generally-planar vertical walls 28 of the fully programmable housing body 16 to implement the function of receiving from the top and supporting shorting clips in position to electrically-short one or more pairs of longitudinally-adjacent contacts 18. As best seen in FIGS. 3 and 4, the ribs 26 on the walls 28 of the fully programmable housing body 16 are vertically aligned with solid-wall portions 30 of the cover 12 that extend between adjacent openings 14 thereof. Any means for supporting the shorting clips while allowing the pivoting of the legs thereof other than the ribs 26 may be employed without departing from the inventive concept. Cavities generally designated 27 are provided by the included wall portions of the walls 28 between longitudinally adjacent ribs 26 that receive the legs of shorting clips to be described as well as receive sockets to be described of the electrodes 18.

Figure 5:
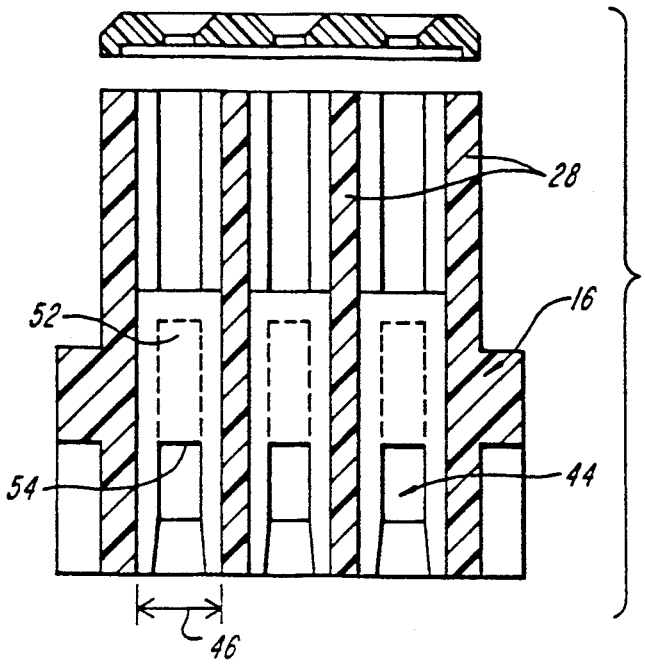
FIG. 5 is a transverse section along the lines 5—5 of FIG. 2 shown with the cover exploded from the housing body and with the cells empty of shorting clips and contacts.
Figure 7:
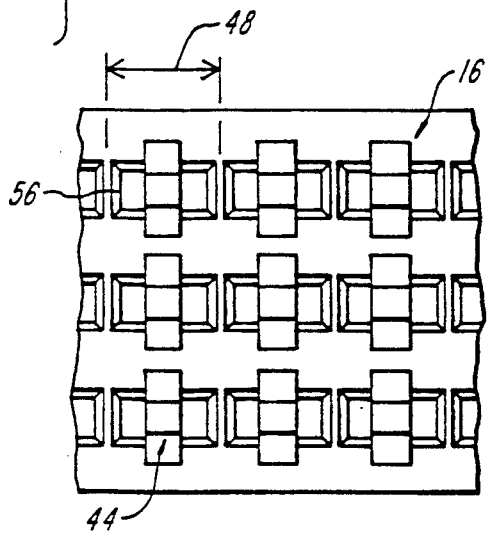
FIG. 7 is a partial bottom plan of the bottom face of a fully programmable DIN connector constructed in accord with the present invention.
Figure 6:
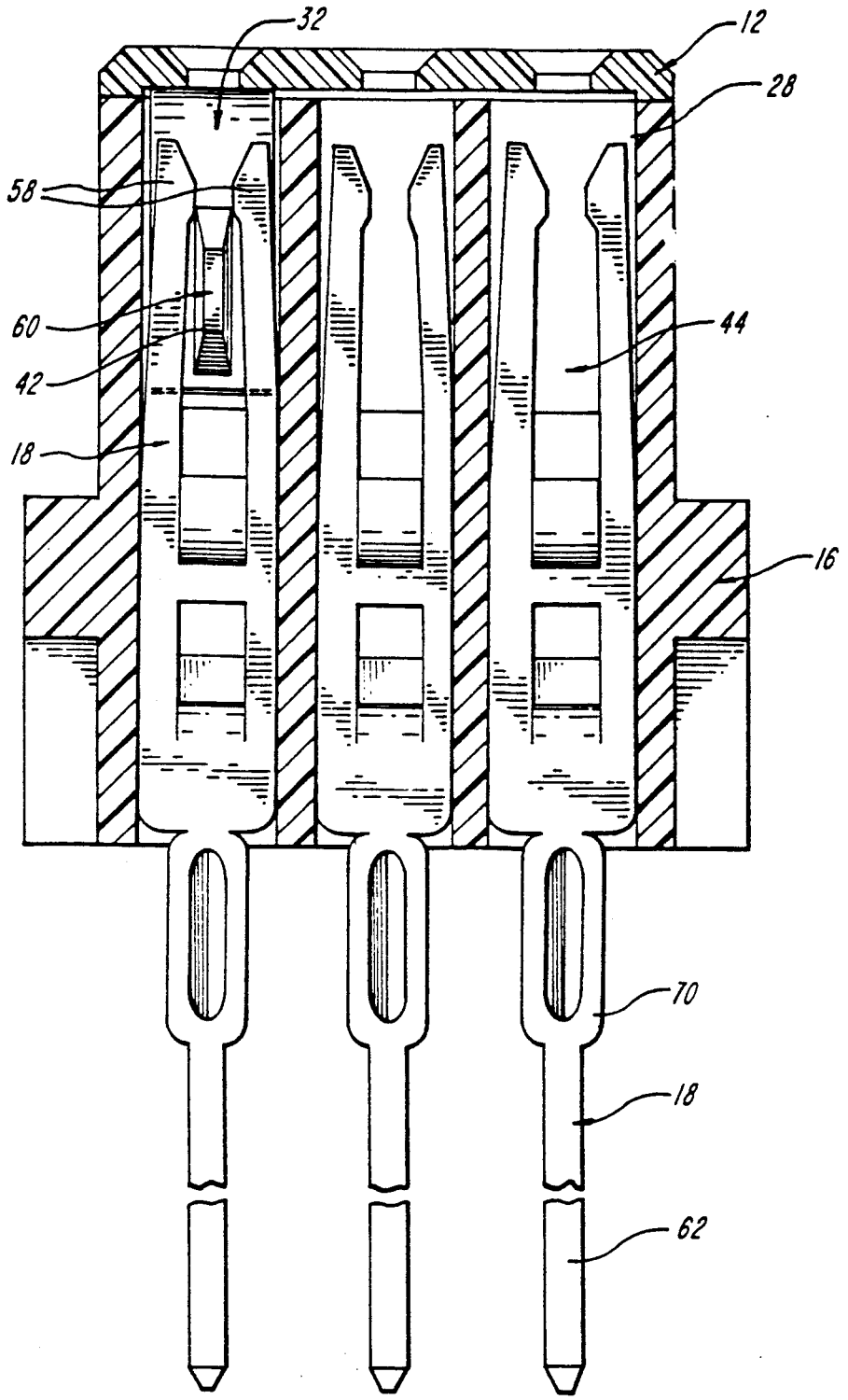
FIG. 6 likewise is a transverse section but shown with the cover in bonded relation to the housing body and with shorting clips selectively loaded into and with contacts loaded into the fully programmable cells of the housing body.

Shorting clips generally designated 32 are received through the open top of the fully programmable housing body 16 and are positioned on and supported by selected pairs of the confronting ribs 26 as best seen in FIG. 4. The shorting clips 32 are each of a generally U-shaped electrically-conductive material, such as (please specify), having two opposed legs 34 joined by resilient bridges 36, wherein each leg 34 includes at least one contact edge 38 located along the foot 40 thereof and a non-conductive protuberance 42, and wherein the space defined between the contact edges of the feet of the legs correspond to the longitudinal width of the solid wall portion 30 of the cover 12, also as best seen in FIG. 4. Reference may be had to co-pending, commonly-assigned and allowed United States utility patent application entitled *Self-Operative Electrical Shunting Contact and Method for Forming*, Ser. No. 07/596,244, filed Oct. 12, 1990, incorporated herein by reference, for a description of the preferred methods for manufacturing the shorting clips and for a description of alternative embodiments thereof. It should be noted that the number and placement of the shorting clips in the FIG. 2 is exemplary only, and that any number (zero or positive integer) and any arrangement of such clips may be implemented to satisfy the requirements of a particular application. In the presently preferred embodiment, plural, spaced apart walls defining vertically extending contact receiving cavities generally designated 44 are provided in the fully programmable housing body that individually are aligned with another opening 14 of the cover member 12 and that taken pairwise are each longitudinally to either side of another pair of confronting ribs 26 to implement the function of receiving through the bottom surface of the housing 16 the contacts 18 in such a manner as to both align the contacts 18 with the openings 14 of the cover 14 and to support longitudinally-adjacent pairs of contacts 18 in position to be electrically-shorted when such pairs have been selected to be electrically-shorted by corresponding one or more shorting clips. Each of the contact receiving and supporting cavities 44 of the housing body 16 has a transverse width as designated by an arrow 46 (FIG. 5) that is defined by the inside distance between confronting pairs of walls 28 as best seen in FIGS. 5 and 6, and has a longitudinal width as designated by an arrow 48 that is slightly larger than the outside distance between seating tangs to be described of the contacts 18 as best seen in FIG. 7. The walls of each of the cavities 44 vertically extend from the bottom surface of the housing 16 and open into a corresponding one of the shorting clip leg-receiving cavities 27 defined to either side of each shorting clip supporting rib 26, and have vertically-spaced and longitudinally-aligned shoulders 52, 54 which define anti-rotation stops for the seating tangs of the several contacts 18 as best seen in FIGS. 3 and 4. Preferably, the mouth of each of the cavities 44 proximate the bottom face of the housing 16 is beveled as at 56 to facilitate insertion of corresponding contacts 18 thereinto as best seen in FIGS. 3 and 4.

The contacts 18 each have twin fingers 58 confronting each other on one end to provide a socket generally designated at 60 into which a pin of a mating connector, not shown, is insertable, and each have depending electrode tails 62 on their other ends that provide a pin that is received by the socket of a mating connector, not shown, or by a printed circuit board or other interconnection device, not shown.

Between each pair of confronting fingers 58 and each electrode tail 62 is a box-beam generally designated 64. To stabilize each contact 18 against transverse twisting when seated in their corresponding cavity 44, the width of each box-beam 64 is selected to match that of the transverse width of the cavities 44. Preferably, the transverse width of the sockets 60 is selected to decrease towards their free-ends by an amount that facilitates the bottom loadability of the sockets 18 as best seen in FIG. 6.

To stabilize each contact 18 against longitudinal twisting when seated in their corresponding cavity 44, vertically-offset and outwardly projecting seating tangs 66, 68 thereof seat against corresponding ones of the vertically-spaced shoulders 52, 54 of each of the cavities 44 as best seen in FIG. 4.

Intermediate the box-beam 64 and the electrode tails 62 is an integral leaf-spring 70 whose resilience holds the pin 62 of the corresponding contacts 18 securely when it is pressed in its mating interconnection device, not shown.

Modifications to the contacts 18, and corresponding modifications to their corresponding mating connectors, are possible without departing from the inventive concept, so long as the contacts employed have socket and pin ends, and so long as the same are able to be securely retained precisely in position in the housing body 16 by suitable seating and securing means. Reference may be had to the above-incorporated United States utility patent application for a description of the contacts therein shown and described.

Referring again to FIG. 2, simply by inserting one or more shorting clips 32 onto one or more shorting clip receiving ribs 26, the ten (10) shorting clips 32 being merely illustrative of one possible configuration, the same programmable body 16 may be programmed to enable any one or more selected pairs of contacts 18 that are located longitudinally to either side of the one or more shorting clips to be nominally shorted in the absence of a pin being plugged into either of the sockets of any such pair of contacts. For any such selected configuration, as best seen in FIG. 4, the contact edges 38 of the feet 40 of the one or more shorting clips 32 supported by the ribs 26 each contact longitudinally adjacent sockets 60 of the contacts 18 thereby electrically shorting the same via the circuit path provided by the corresponding bridge 36, and, as best seen in FIGS. 4 and 6, the insulative protuberances 42 of the one or more shorting clips 32 freely extend through the interspace 62 defined between the corresponding fingers 58 of the sockets 60 of the longitudinally adjacent contacts 18.

Shorting clips 32 may be inserted into any selected one or more cells of the housing body to program the DIN connector to the particular application. To program the connector for a selected configuration, a template, not shown, having an opening pattern that conforms to the particular cell(s) of the housing 16 selected to receive shorting clip(s) 32 may be employed. Once inserted, the one or more shorting clips, that rest on the ribs 26, whenever the connector is programmed, are constrained against twisting thereon by abutment of their lateral edges with the confronting surfaces of the walls 28. The same housing 16 for any selected configuration of shorting clips may readily be programmed.

Thereafter, the cover 12 is bonded to the housing body 16, as by ultrasonically welding posts 72 upstanding on top of the housing body 16 into the apertures 28 provided therefor in the cover as seen in FIG. 2. Other techniques such as heat-staking, well-known to those skilled in the art, may be employed as well to bond the cover 12 to the housing body 16.

Figure 8:
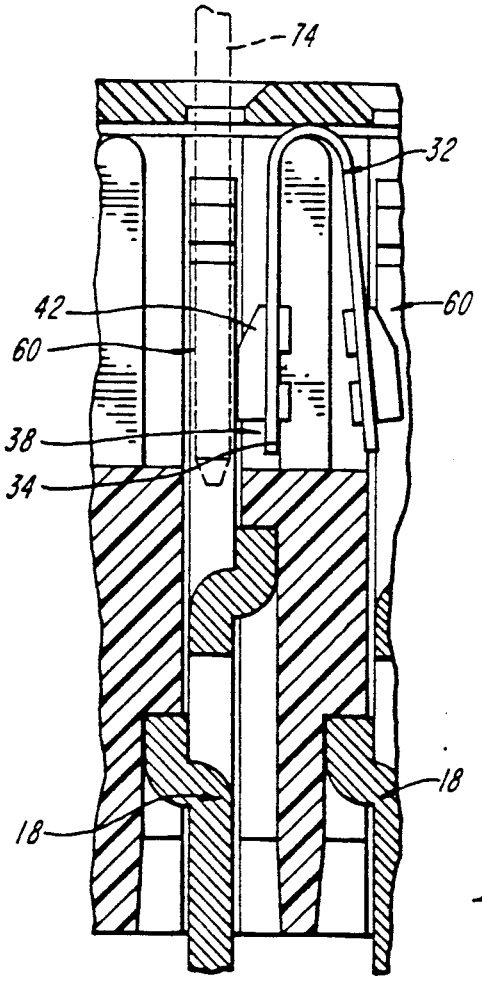
FIG. 8 is a partial longitudinal section illustrating a pin received within a socket of a contact of a cell of the housing body of the fully programmable DIN connector constructed in accord with the present invention.

As best seen in FIG. 8, should a pin, shown dashed at 74, of a mating male connector, not shown, be inserted into any socket 60 that is nominally shorted by means of the intermediate shorting clip with the socket 60 of a longitudinally adjacent contact 18, the pin 74 contacts the insulative protuberance 42 of the shorting clip 32 and the corresponding leg 34 pivots in such a way that the contact edge 38 thereof is moved out of mechanical and electrical contact with the socket 60 into which the pin is inserted. With the removal of the pin the leg resiliently pivots back and re-establishes the nominal electrical-shorting relation between adjacent sockets, before pin 74 breaks contact with contact 18.

Many modifications, such as the fact that the invention is useful in any multi-position or multi-contact DIN or non-DIN connector in which one or more shorting clips are to be installed, will become apparent to those skilled in the art having benefitted by the disclosure of the instant invention.

What is claimed is:

1. A fully programmable connector that enables the same connector to be programmed to electrically short any selected one or more pairs of contacts, comprising:

a housing body having opposing top and bottom faces between which a plurality of identical, selectively programmable cells are arrayed in a selected configuration;

each of said selectively programmable cells of the housing body is comprised by first walls that open to the top face of the housing body and define a top-face-loadable shorting clip supporting member, by second walls that open to the top face and define socket receiving cavities on both longitudinal sides of the shorting clip supporting members, and by third walls that open to the bottom face and define on both longitudinal sides of the shorting clip supporting members bottom loadable contact receiving and supporting cavities;

a plurality of contacts having integral sockets and pins bottom loaded into the bottom loadable contact receiving and supporting cavities defined by the third walls of the several cells, with their sockets received in a corresponding socket receiving cavity and with their pins individually extending beyond the bottom face of the housing body; and a preselected number of shorting clips top loaded into said housing body and supported by the associated shorting clip supporting members of any one or more selected cells.

2. The invention of claim 1, wherein said selected configuration of said housing body of said connector is a DIN configuration.

3. The invention of claim 1, wherein said preselected number is a selected integer.

4. The invention of claim 1, wherein said first walls include a shorting clip supporting abutment.

5. The invention of claim 4, wherein said housing body proximate said top face is constituted by a plurality of longitudinally-extending vertically-oriented and transversely-spaced generally-planar walls, and wherein said abutment includes a vertically-extending rib formed on confronting inside surfaces of said longitudinally-extending generally-planar walls.

6. The invention of claim 5, wherein said rib includes a rounded-top portion.

7. The invention of claim 1, wherein said housing body proximate said top face is constituted by a plurality of longitudinally-extending vertically-oriented and transversely-spaced generally-planar walls, wherein said first walls include a shorting clip supporting abutment formed on said transversely-spaced and generally-planar walls, and wherein said second walls are included wall portions of said transversely-spaced and generally-planar walls of said housing body that extend between longitudinally adjacent shorting clip supporting abutments.

8. The invention of claim 7, wherein said shorting clip supporting abutments are vertically-extending ribs.

9. The invention of claim 8, wherein said ribs include a rounded-top.

10. The invention of claim 1, wherein said contacts each have first and second vertically-spaced and outwardly projecting seatings tangs, wherein said housing body proximate said top face is comprised by a plurality of longitudinally-extending vertically-oriented and transversely-spaced generally-planar walls, and wherein said bottom loadable contact receiving and supporting cavities defined by each said third walls have a transverse width that corresponds to the inside dimension defined by the transversely-spaced generally-planar walls proximate the top face of the housing body, and have a longitudinal width defined by the outside distance between projecting ends of the first and second vertically-spaced and outwardly projecting seating tangs of the contacts.

11. The invention of claim 10, wherein said third walls are further comprised by vertically-spaced shoulders that are vertically spaced a distance that corresponds to the vertical spacing of the vertically-spaced first and second seating tangs of the several contacts.

12. The invention of claim 11, wherein the housing body proximate the bottom face and in regions surrounding each of the bottom loadable contact receiving and supporting cavities is so beveled as to facilitate the insertion of contacts thereinto.

13. The invention of claim 1, wherein each of said contacts having integral sockets and pins is comprised by twin confronting cantilevered beams that define each of said sockets that terminate in a corresponding pin through an intermediate contact strength member.

14. The invention of claim 13, wherein said intermediate strength member includes a box-beam about which first and second vertically-spaced and outwardly projecting seating tangs are formed.

15. The invention of claim 14, further including an integral leafspring intermediate the box-beam and the pin of each of the contacts.

16. The invention of claim 13, wherein said twin confronting beams have outside surfaces that taper towards their ends to facilitate their bottom loadability.

17. The invention of claim 1, wherein said shorting clips are each of a generally U-shaped electrically-conductive material having two opposed legs joined by a resilient bridge, each leg including at least one contact edge located along a foot thereof and a non-conductive protuberance.

18. The invention of claim 1, further including a housing cover having a plurality of openings that correspond in number to the plurality of sockets, and wherein the outwardly facing surface of the cover in the region surrounding each of the openings of the plurality of openings is so beveled as to facilitate the entry of a pin thereinto.

19. The invention of claim 18, wherein said housing cover is mated to said housing body by means of interlocking posts and openings that are staked together by ultrasonic welding.

20. The invention of claim 1, further including a housing cover mated to a top face of the housing body.

21. The invention of claim 20, wherein said housing cover and said housing body are each integrally formed.

22. The invention of claim 20, wherein said housing cover is fashioned from LCP (liquid crystal polymer), and said housing body is fashioned from PBT (glass-filled polyester).

* * * * *